US005779067A

United States Patent [19]

Reaney

[11] Patent Number: 5,779,067

[45] Date of Patent: Jul. 14, 1998

[54] VERTICAL REFRIGERATOR SIDE RACK AND METHOD

[76] Inventor: Everette A. Reaney, 200 Childress Circle, Greenville, S.C. 29611-2611

[21] Appl. No.: 711,991

[22] Filed: Sep. 10, 1996

[51] Int. Cl.[6] ..... A47F 5/00

[52] U.S. Cl. ..... 211/90.04; 211/94.01; 211/162; 211/134; 312/330.1

[58] Field of Search ..... 211/134, 162, 211/71.01, 79, 90.01, 90.04, 94.01, 151, 126.15, 94.02; 312/201, 330.1, 287

[56] References Cited

U.S. PATENT DOCUMENTS 447,658 3/1891 Brockmann ..... 211/162
1,750,291 3/1930 Whetstone ..... 312/330.1 X
3,298,195 1/1967 Raskhodoff ..... 312/330.1 X
5,072,838 12/1991 Price et al. ..... 211/162
5,265,739 11/1993 Price et al. ..... 211/162

*Primary Examiner*—Robert W. Gibson, Jr.
*Attorney, Agent, or Firm*—Ralph Bailey

[57] ABSTRACT

A vertical rack and method of storage provides for mounting on an outside side wall of a refrigerator vertically spaced horizontal shelves (A) carried by a frame (B) which has a base support member carrying spaced wheels (C) for extending and retracting the rack which is carried by a mounting plate (D) on extensible slides (E) for carrying the frame for movement between extended and retracted positions.

9 Claims, 2 Drawing Sheets

VERTICAL REFRIGERATOR SIDE RACK AND METHOD

BACKGROUND OF THE INVENTION

This invention relates to a storage rack for carrying canned goods and the like outside of a refrigerator for convenience and to conserve space.

Potential storage space to the side of refrigerators is often wasted because there has been no way to utilize what is often a narrow inaccessible area. Moreover, it is desirable to provide a storage space for canned goods and other household products which do not require refrigeration but which are more conveniently accessible when in close proximity to a refrigerator.

Constant efforts have been made to enhance the usefulness of refrigerators. For example, U.S. Pat. Nos. 4,534,530; 5,323,917 and 5,396,997 relate to storage racks albeit positionable inside of the refrigerated area. U.S. Pat. No. 4,400,951 illustrates a combination food freezer and dining table.

Therefore, it would be desirable to utilize narrow spaces adjacent refrigerators which often go to waste for want of suitable storage devices, while combining and enhancing the usefulness of the refrigerator by providing a support useful in conjunction therewith for carrying food stuffs, cleaning products, etc. which do not require refrigeration adjacent the refrigerator doors and to the side of the refrigerator.

For purposes of accessibility and convenience as well as to maximize the usefulness of what is now waste spaces it is desirable that the articles be received and stored in rows of single article depth in enclosed spaces having heights such as to maximize the efficiency of the vertical spacing of the rows.

SUMMARY OF THE INVENTION

Accordingly, it is an important object of this invention to provide a storage rack for external mounting on a refrigerator side panel for conserving space while providing a convenient storage location.

Another important object of the invention is the provision of a storage rack external to a refrigerator which is extensible for gaining access to food stuffs stored therein but which is retractable for storing the articles in an out of the way location.

It has been found that a vertical rack may be provided for storage and mounted on the outside wall of a refrigerator and preferably to the side of the refrigerator for positioning vertically spaced shelves carried by a frame with a base support and providing wheels for extending and retracting the vertical rack which is carried by a mounting plate for securing at least one extensible slide for mounting the rack on the exterior refrigerator side wall.

Another important object of the invention is to provide apparatus and method of positioning vertically spaced rows of containers preferably of single article depth in a narrow space which is extensible on slides carried on a refrigerator and retractable to a recessed enclosed out of the way location.

Another object of the invention is to provide an improved slide assembly for positioning externally of a refrigerator for extension and retraction on slides which afford limited vertical movement to avoid binding when supporting a relatively heavy rack and contents for substantial distances.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
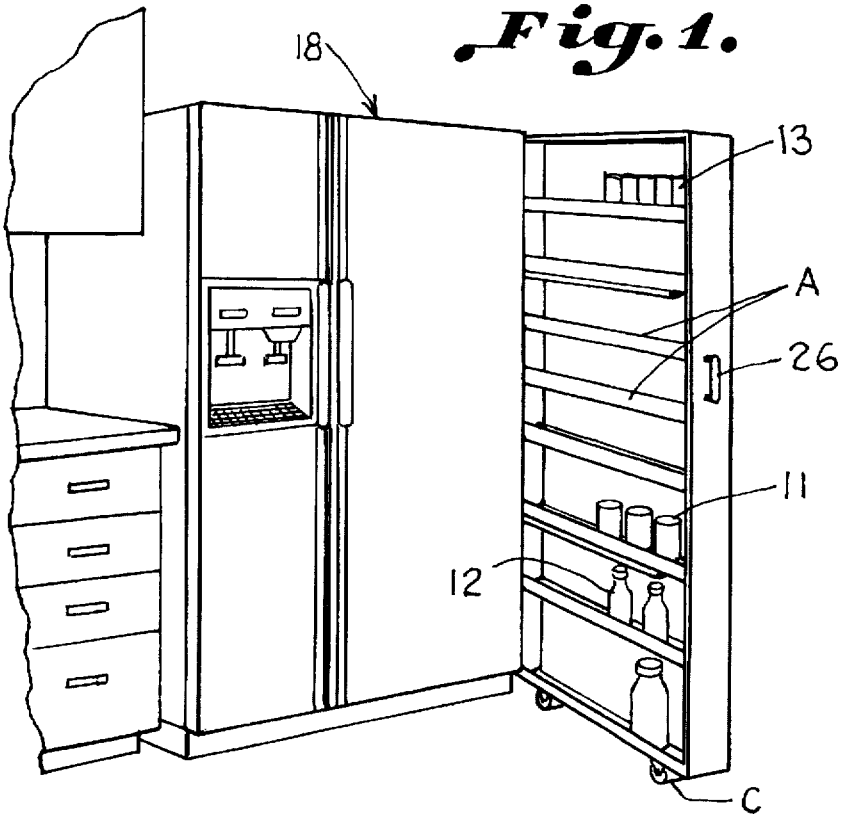
FIG. 1 is a perspective view looking from the left front illustrating a vertical rack constructed in accordance with the invention in fully extended position to a side of the refrigerator.
Figure 3:
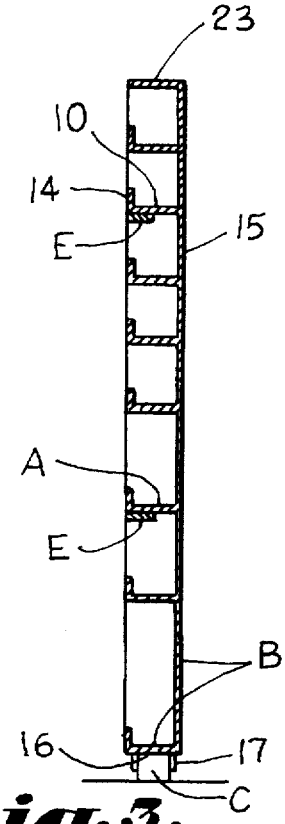
FIG. 3 is a side elevation schematically illustrating slides for mounting the rack on a refrigerator side wall to make the rack accessible by facilitating either full or partial extension of the rack in relation to the refrigerator.
Figure 2:
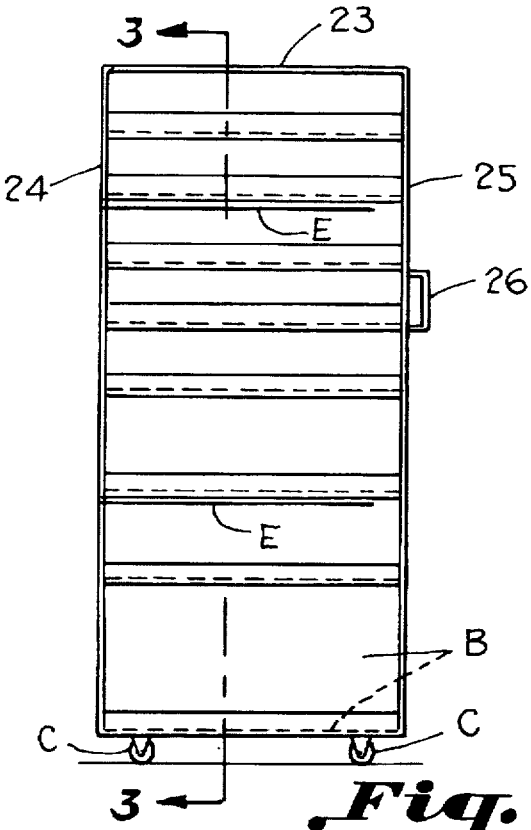
FIG. 2 is a front elevation looking toward an open side of the rack showing the shelves stacked in vertical relation therein with spaced wheels carried by a base support member for extending the vertical rack outside beyond the front of the refrigerator for gaining access to the items stored therein.

A vertical rack for mounting on an outside wall of a refrigerator includes a plurality of aligned vertically spaced horizontal shelves A each having a depth suitable for carrying a single row of canned goods longitudinally disposed from front to rear across a side wall of the refrigerator. A frame B has a base support member aligned with the shelves, a top opposite said base and a side member remote from said side wall. Spaced wheels C are carried by the base support member for rotatably carrying the vertical rack on the floor for movement from a retracted position to an extended position exposing the shelves and their contents extending outwardly beyond the refrigerator while being supported thereby. A mounting plate D extends across the side wall for securing the frame to the wall. An extensible slide E carries the frame for movement from retracted to extended position. Thus, space adjacent a side of a refrigerator is conserved while positioning articles including canned goods for ready access.

The vertical shelves A are illustrated as including a flat support member 10 for carrying canned goods 11, bottled goods 12 or other household supplies such as glasses 13. The shelves A further include an upturned outer end 14 for confining the canned goods and the like on the horizontal supports 10 between the upturned member and a rear wall 15 which constitutes a part of the frame B. A suitable depth for the shelves has been found to be approximately 5" for receiving the articles, and a single depth of articles is preferred. Thus, a single row of canned goods is both visible and readily accessible. The frame B further includes a bottom shelf which serves as a base support member in vertical alignment with the shelves spaced thereabove. A bottom surface 16 of the base support member carries the spaced wheels C.

The wheels C are illustrated as being disposed transversely of the shelves and carried by brackets 17 affixed to the lower surface 16 so as to turn about a transverse axis tending to guide the rack for movement from rear or retracted to front or extended position. The wheels support the load imposed by the rack and contents.

Figure 4:
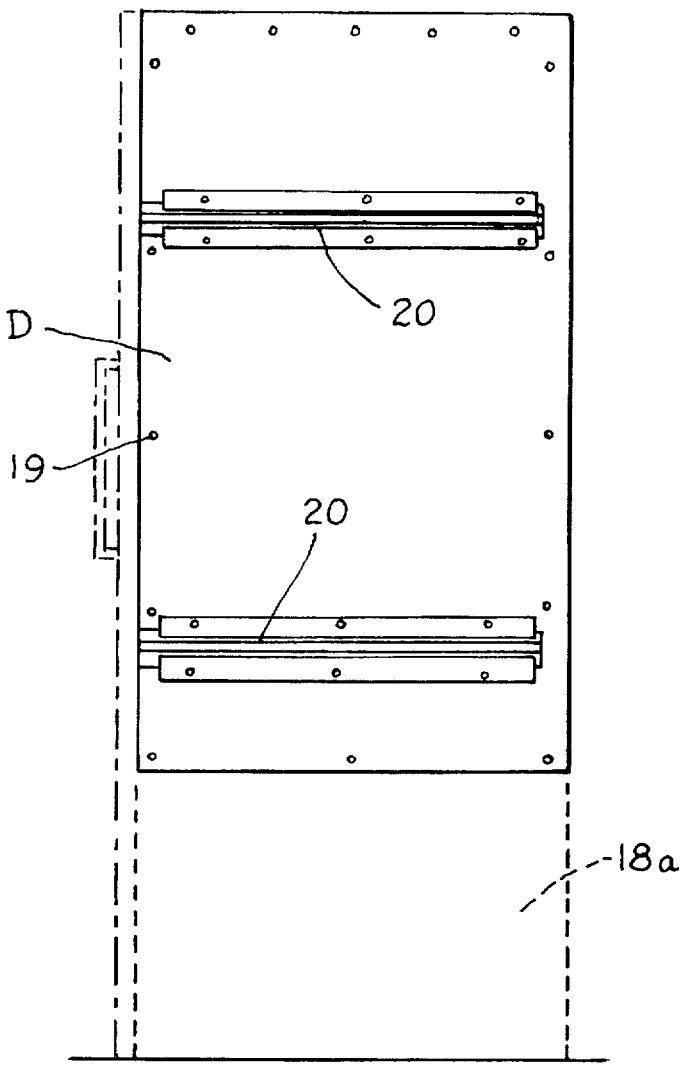
FIG. 4 is a front elevation illustrating a mounting plate for securement of the slides to a refrigerator side wall.

The rack is carried in vertical position by a suitable mounting plate D which is illustrated in FIG. 4 as being affixed to the side wall 18*a* of a refrigerator broadly designated at 18. The mounting plate may be suitably attached as by glue or by pop rivets illustrated at 19. Any other suitable means of attachment may be employed. For example, screws may be utilized for fastening into threaded plate, or brackets built into the refrigerator or freezer cabinet by the refrigerator or freezer manufacturer. If desired the mounting plate may be attached with Velcro. Double-face tape can be used in some areas. Straps or plates on top and sides may be held in place by angle brackets, which in turn hold the mounting plate.

Figure 5:
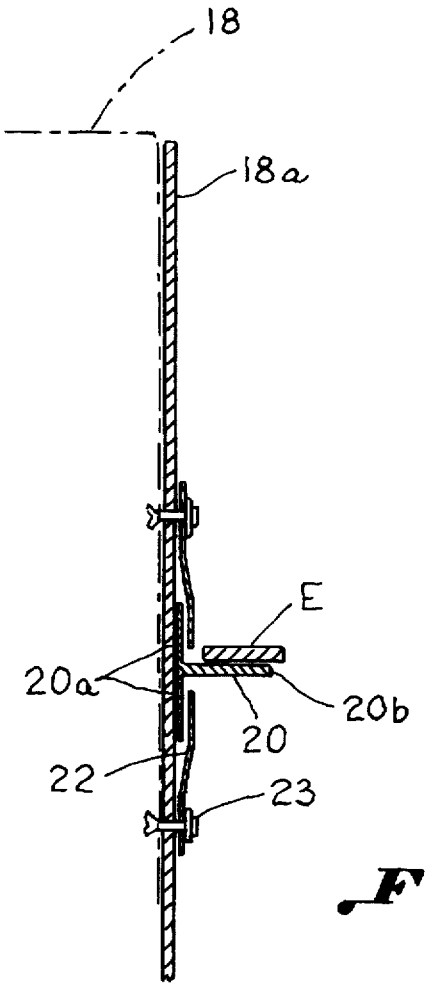
FIG. 5 is a front elevation illustrated the positioning of a slide on a support carried by the mounting plate illustrated in FIG. 4 permitting limited vertical movement of the assembly to avoid binding of the apparatus when extending and retracting the vertical rack preferably substantially entirely beyond the doors of the refrigerator for free access to the contents.

FIG. 5 illustrates a preferred manner of mounting an extensible slide E, carried by the rack, on the mounting plate D. The slide E is illustrated as being carried by a substantially T-shaped section 20 which includes a pair of legs 20*a* carried by the web section 20*b*. The legs 20*a* are confined within retaining vertical plate members 21 and 22 which are suitably secured by rivets 23. The retaining members 21 and 22 loosely receive the legs 20*a* so as to provide limited vertical movement to relieve any stresses which might cause binding in connection with the use of conventional slides. The slides are schematically illustrated in the drawings at E. Preferably, these slides are of the type utilizing three telescoping sections to permit full extension of the rack. Suitable slides are sold under the designation *Series* 3832*A by The Accuride of* Santa Fe Springs, Calif.

The rack includes a top 23 opposite the base surface 16 and front and rear walls 24 and 25, respectively. A suitable handle is illustrated at 26.

It is thus seen that an important addition may be made to kitchen storage space while utilizing what would normally be lost space. The slidable racks may be inexpensively manufactured for easy installation. The racks hereof may be mounted on either or both sides of a refrigerator and in some situations on a back surface. Preferably the racks have front and back walls in substantial alignment with the front and back of standard refrigerators.

While a preferred embodiment of the invention has been described using specific terms, such description is for illustrative purposes only, and it is to be understood that changes and variations may be made without departing from the spirit or scope of the following claims.

What is claimed is:

1. A vertical rack for mounting outside and on a side wall of a refrigerator comprising:

a plurality of aligned vertically spaced horizontal shelves each having a depth suitable for carrying a single row of canned goods longitudinally disposed from front to rear across said side wall;

a frame supporting said shelves and having a base support member aligned with the shelves, a top opposite the base and a side member remote from the side wall;

spaced wheels carried by said base support member for carrying the vertical rack on the floor for movement from a retracted position to an extended position exposing the shelves and their contents extending outwardly beyond the refrigerator while being supported thereby;

a mounting plate extending across said side wall for securing the rack to the wall; and an extensible slide on said mounting plate on said side wall carrying said rack for said movement from retracted to extended position;

whereby space adjacent a side of a refrigerator is conserved while positioning articles including canned goods for ready access.

2. The structure set forth in claim 1 including a front and a back for said frame, and wherein the depth of said shelves and said frame is suitable for carrying a single row of canned goods.

3. The structure set forth in claim 2 wherein said wheels are transversely disposed and spaced longitudinally of said frame.

4. The structure set forth in claim 1 wherein said mounting plate extends entirely across and is fixed to said side wall.

5. The structure set forth in claim 1 wherein said slide includes telescoping sections for extension of said frame beyond said side wall exposing said canned goods.

6. The structure set forth in claim 1 wherein a plurality of vertically spaced slides on said mounting plate on said side wall each include three telescoping sections for full extension of said frame, and a support therefor carried by said mounting plate.

7. The structure set forth in claim 1 including a longitudinal mounting member supporting said slide and the rack carried thereby for limited vertical movement avoiding binding of the frame and slide.

8. The method of supporting canned goods outside on a side wall of a refrigerator comprising the steps of:

providing a plurality of aligned vertically spaced horizontal shelves each having a depth suitable for carrying a row of canned goods longitudinally disposed from front to rear across said side wall;

securing a base support member in vertical alignment with the shelves;

positioning spaced wheels on said base support member for carrying the vertical rack on the floor for movement from a retracted position to an extended position exposing the shelves and their contents extending outwardly beyond the refrigerator while being supported thereby;

securing the rack to the side wall; and carrying said rack on a slide fixed in alignment in respect to said refrigerator for movement from retracted to extended position;

whereby space adjacent a slide of a refrigerator is conserved while positioning articles including canned goods for ready access.

9. The method set forth in claim 8 including the steps of:

positioning a plurality of vertically aligned slides on said side wall; and providing a longitudinal mounting member for each slide permitting limited vertical movement to avoid binding of the slides.

* * * * *